United States Patent [19]

Lobb

[11] Patent Number: 4,987,743

[45] Date of Patent: Jan. 29, 1991

[54] CRYOGENIC REFRIGERATORS

[75] Inventor: Alexander J. Lobb, Bookham, United Kingdom

[73] Assignee: The BOC Group plc, Windlesham, United Kingdom

[21] Appl. No.: 376,337

[22] Filed: Jul. 6, 1989

[30] Foreign Application Priority Data

Jul. 7, 1988 [GB] United Kingdom ..... 8816193

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,625,015 | 12/1971 | Chellis | 62/6 |
| 3,733,837 | 5/1973 | Lobb | 62/6 |
| 4,397,156 | 8/1983 | Heisig et al. | 62/6 |
| 4,471,626 | 9/1984 | Sarcia | 62/6 |
| 4,761,963 | 8/1988 | Kiese | 62/6 |

*Primary Examiner*—Ronald C. Capossela

*Attorney, Agent, or Firm*—Robert I. Pearlman; David M. Rosenblum

[57] ABSTRACT

The present invention provides a coldhead drive unit for a cryogenic refrigerator including a casing having an inlet for supplying a fluid into the casing at a working pressure and a valve positioned within the casing for controlling the supply of the fluid to and from the cold head. The valve comprises a valve plate and a valve head positioned against the valve plate and having a surface distal to the valve plate against which the working pressure acts. An effective pressure of less pressure than the working pressure acts at the interface between the valve head and the valve plate so that an axial force is exerted upon the distal surface of the valve head, driving the valve head against the valve plate. Additionally, a motor is included having a drive shaft for rotating the valve head against the valve plate. The drive shaft engages the valve head in a fluid tight manner within a bore formed in the distal surface of the valve head and the valve head has a channel linking the sealed interior of the bore and the interface between the valve head and the valve plate. As a result, the area of the distal surface subjected to the working pressure is reduced in an amount equal to the cross-sectional area of the bore to thereby reduce the magnitude of the axial force.

8 Claims, 2 Drawing Sheets

FIG. 2.
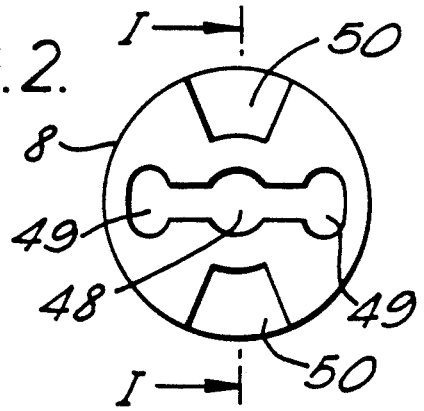
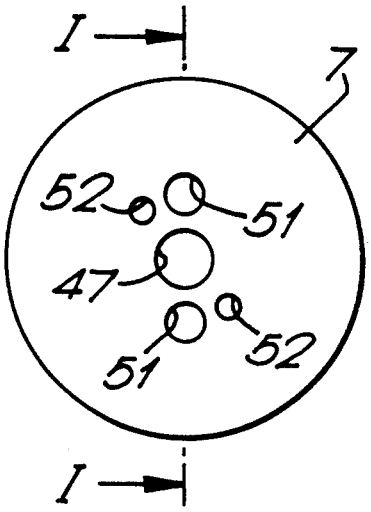
FIG. 3.
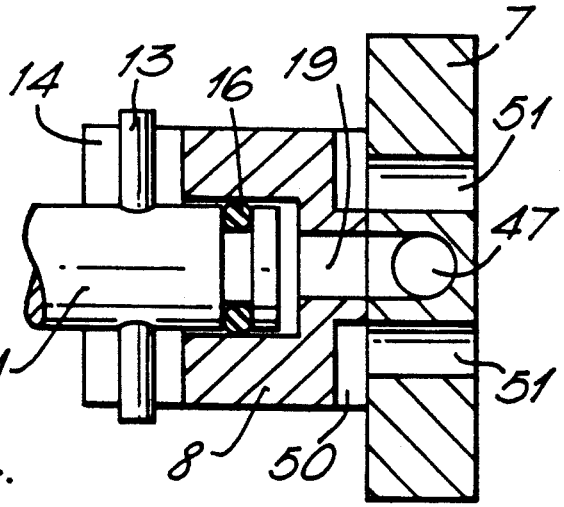
FIG. 4.

CRYOGENIC REFRIGERATORS

BACKGROUND OF THE INVENTION

The present invention relates to cryogenic refrigerators, in particular those operating to the Gifford McMahon or Solvay cycles or derivatives thereof, and more particularly to coldhead drive units thereof.

Coldheads of such cryogenic refrigerators may be broken down into two general category types, firstly those in which a displacer is mechanically actuated and secondly those in which a displacer is pneumatically actuated.

In the case of pneumatically actuated coldheads, these usually include a drive unit including valve means which has a rotary valve head cooperating with a static valve plate. At the interface between the valve head and valve plate, there are discrete ports which, by periodic alignment of the different ports, allow the passage of a working fluid to and from the regenerators and working volumes of the coldhead.

To maintain a necessary contact between the valve head and the valve plate, it is customary for the valve head surface distal to the valve plate to be subjected to a higher pressure than the effective pressure at the interface between the valve head and valve plate.

Furthermore, the diameter of the valve head must clearly be adequate to allow ports of sizes sufficient to allow for the passage of a flow of working fluid to and from the coldhead working volumes without significant restriction.

The valve head can be driven by a motor which must have sufficient torque to rotate the valve head which, for a given valve head to valve plate coefficient of friction, is dependent on the valve head/valve plate interface area, the interface diameter and the axial pressure differential operating on the valve head. Motor torque requirements are therefore very sensitive to the valve head diameter and axial pressure differential.

It has now been found that a modification to the valve means allows for an increase in the size of the valve head/plate interface to suit increasing sizes of coldhead without the need necessarily to increase the size of motor required to drive the valve head. This generally has the benefit of allowing a range of cryogenic refrigerators having different refrigerating capacities to employ a common valve drive motor. This has the advantage of reducing manufacturing costs and of allowing each member of the range to be connected to a common power supply. Furthermore, it generally reduces the valve head load against the valve plate, thereby reducing wear at the interface and increasing the life of these components.

SUMMARY OF THE INVENTION

In accordance with the present, there is provided a coldhead drive unit for a cryogenic refrigerator including a casing, valve means positioned within the casing for controlling the supply of a fluid to and from the coldhead and comprising a valve head, a valve plate and interengageable porting at an interface therebetween, and a motor having a drive shaft for rotating the valve head against the valve plate, means being provided for the supply of a fluid at a working pressure about a surface of the valve head distal to the valve plate, wherein the drive shaft engages the valve head in a fluid tight manner within a bore formed in the distal surface of the valve head and wherein a channel is provided in the valve head to link the sealed interior of the bore and the interface between the valve head and valve plate.

The invention is based on the fact that, by allowing pressure in the valve head and valve plate interface to act on part of the distal surface of the valve head via the channel in the valve head, the axial loading between the valve head and the valve plate is reduced.

The channel is preferably formed between a port in the valve head and communicating with the sealed interior of the bore. Generally that port is one which communicates to low pressure at the interface. Most preferably the channel is formed in a port which is centrally situated in the valve head.

For normal operation of the valve means, it will be advantageous for the valve head to be able to move longitudinally with respect to the drive shaft to accommodate manufacturing tolerances and to accommodate wear of the valve head and the valve plate at their mutal interface.

In preferred embodiments of the invention, the drive unit includes a primary shaft on which is mounted an extension piece, the extension piece engaging in a fluid tight manner in the bore formed in the distal surface of the valve head and forming the sealed interior of the bore on that side of the seal nearest the valve plate.

Preferably, the extension piece is sealed within the bore of the valve head by means of an 'O'-ring seal about the extension piece. Most preferably, the extension piece has, at its distal end, a flange, a spring being mounted on the extension piece between the flange and the distal surface of the valve head to maintain valve head location against the valve plate when pressure difference is absent, for example during non-use.

In general, it is advantageous for the rotary motion of the drive shaft to be transmitted to the valve head by a pin extending through the drive shaft or extension piece thereof and engaging within slots formed in the distal surface of the valve head.

BRIEF DESCRIPTION OF THE DRAWING

For a better understanding of the invention, reference will now be made, by way of example only, to the accompanying drawings in which:

FIG. 2 is a face profile of a valve head forming part of the coldhead drive unit of FIG. 1;

FIG. 3 is a face profile of a valve plate forming part of the coldhead drive unit of FIG. 1;

FIG. 4 is a cross-sectional view of a drive unit of coldhead of modified construction.

DETAILED DESCRIPTION OF THE INVENTION

Figure 1:
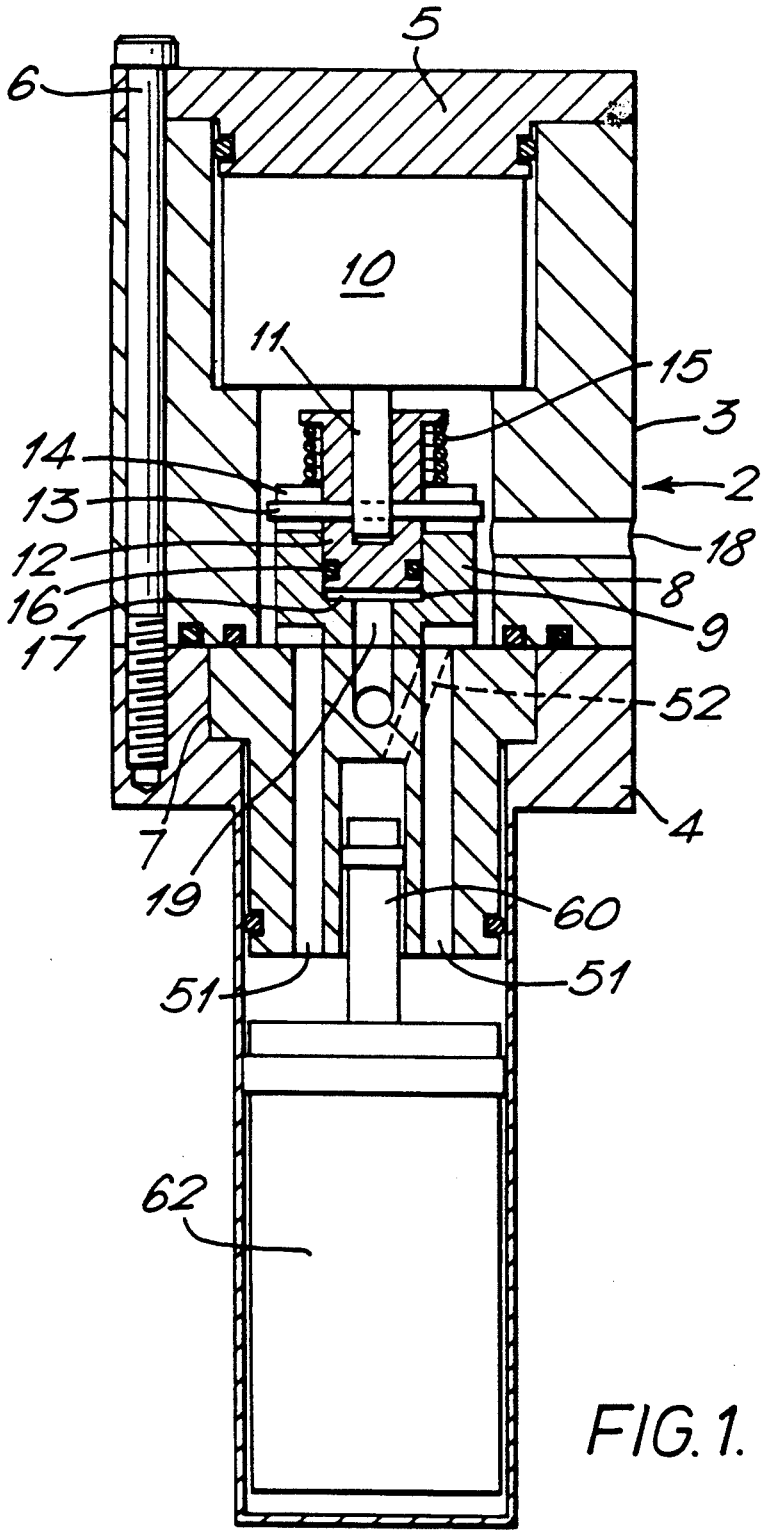
FIG. 1 is a schematic cross-sectional view of a coldhead showing a drive unit of the invention.

The coldhead drive unit 2 has a casing comprising a cylindrical side wall 3 attached to a lower casing 4 and having a top portion 5, all of which are sealingly attached by means of a variety of 'O'-ring seals and by bolts 6.

Within the sealed casing are located the various drive unit components. A valve plate 7 is held and sealed within the lower casing 4 as shown and is engaged by a valve head 8. The valve head 8 has in a surface distal to the valve plate 7 a bore 9.

A motor generally indicated at 10 is held within the casing as shown and has a primary drive shaft 11 to which is attached an extension piece 12 which is itself held within the bore 9 of the valve head 8 by means of a pin 13 passing through the shaft 11, the extension piece 12 and engaging slots 14 formed in the valve head 8. The valve head is thereby allowed a certain amount of longitudinal movement relative to the shaft 11 by virtue of the shape of the slots 14 but is constrained from substantial rotational movement relative to the shaft 11. A spring 15 urges the valve head 8 downwards (as shown) towards the valve plate 7.

The extension piece 12 is sealed within the bore 9 by means of an 'O'-ring seal 16, thereby forming a sealed interior 17 of the bore.

An inlet 18 is present in the casing for the introduction of fluid at a working pressure into the chamber about the surfaces of the valve head 8 distal to the valve plate 7. The spring 15 acts mainly to retain engagement between the valve head and the valve plate during non-use.

A channel 19 is present in the valve head linking the interface of the valve head and valve plate with the sealed Interior 17 of the bore 9 beneath (as shown) the 'O'-ring seal 16.

FIG. 2 and 3 show the interengageable porting at the interface between the valve head 8 and the valve plate 7 respectively, the sectional view of FIG. 1 being indicated by the lines "I-I" on each drawing.

Although not essential to an understanding of the invention, the nature of this porting will be briefly described. A central hole 47 in the valve plate 7 communicates with low pressure exhaust from the coldhead and thereby maintains a central hole 48 in the valve head 8 and slots 49 at nominally low pressure. Slots 50 in the valve head 8 are exposed to the high working pressure within the casing 3. Holes 51 in the valve plate 7 communicate with the coldhead regenerators and working volumes. Holes 52 communicate with a piston drive 60 by which a displacer 62 is actuated.

It is to be understood that alternative pneumatic drive cryocoolers may not have holes 52 or a drive piston 60.

It will be evident, that by rotating the valve head 8 against the valve plate 7 by means of the motor 10 and the drive shaft assembly, holes 51 are alternately pressurised via slots 50 and depressurised by slots 49 out of phase with alternate pressurisation and depressurisation of holes 52.

This arrangement produces two complete cycles of the displacer 62 for every rotation of the valve head 8. Alternative porting arrangements can provide greater or fewer cycles per valve head rotation.

It will be apparent that with the exception of that surface of the valve head 8 in contact with the valve plate 7 the working fluid surrounding the valve head 8 is always at a nominally high pressure. The surface of the valve head 8 in contact with the valve plate 7 is subjected to an effective pressure less than the nominal high pressure. The sealing contact is maintained between the valve head 8 and the valve plate 7 by pressure difference and area. The effective pressure in the valve head 8 and the valve plate 7 interface varies according to their mutual positions and reaches a minimum value when the working volumes are exhausting gas through the valve head 8.

By arranging for the extension piece 12 to be a gas tight fit in the bore 9, and by the provision of a channel 19 between a centrally situated part of the valve head 8 (especially that part subjected to low pressure) and the sealed interior 17 of the bore 9, the area of the distal surface of the valve head 8 subject to the high pressure of the working fluid is reduced so that the effective pressure difference which produces an axial compressive force between the valve head 8 and the valve plate 7 is less than with known designs. Since driving torque is proportional to the product of the valve diameter cubed and effective pressure difference, reducing the surface area of the valve head 8 subjected to high pressure working fluids will enable a motor of a given output torque to be used to turn valve heads of larger diameter than is customary.

Furthermore, the wear on the engaging surfaces of the valve head 8 and the valve plate 7 is greatly reduced due to the lessening of friction forces.

A modified drive unit is illustrated in FIG. 4 where like reference numerals denote like parts in the previous figures. In this modification, the extension piece 12 is omitted and the primary drive shaft 11 engages directly within the bore 9 in a gas tight manner by virtue of 'O'-ring seal 16.

I claim:

1. In a coldhead drive unit for a cryogenic refrigerator including: a casing; supply means for supplying a fluid into the casing at a working pressure; and valve means positioned within the casing for controlling the supply of the fluid to and from the coldhead and comprising, a valve plate, a valve head positioned against the valve plate and having a surface distal to the valve plate against which the working pressure acts, an effective pressure of less pressure than the working pressure acting at the interface between the valve head and valve plate so that an axial force is exerted upon the distal surface of the valve head, driving the valve head against the valve plate, and a motor having drive shaft means for rotating the valve head against the valve plate; the improvement comprising: the drive shaft means engaging the valve head in a fluid tight manner within a bore formed in the distal surface of the valve head; and the valve head having a channel linking the sealed interior of the bore and the interface between the valve head and valve plate, whereby the area of the distal surface subjected to the working pressure is reduced in an amount equal to the cross-sectional area of the bore to thereby reduce the magnitude of the axial force.

2. The improvement according to claim 1 in which the channel is formed between a port in the valve head and the sealed interior of the bore.

3. The improvement according to claim 2 in which the channel and the port are centrally situated in the valve head.

4. The improvement according to claim 1 in which the drive shaft means engages the valve head so that the valve head can more longitudinally with respect to the drive shaft means.

5. The improvement according to claim 1 in which the drive shaft means includes a primary shaft and an extension piece mounted on the primary shaft, the extension piece engaging in a fluid tight manner in the bore formed in the distal surface of the valve head by a seal and forming the sealed interior of the bore on that side of the seal nearest the valve plate.

6. The improvement according to claim 5 in which the seal comprises an "O"-ring seal about the extension piece.

7. The improvement according to claim 5 in which the extension piece has, at its distal end, a flange, and a spring mounted on the extension piece between the flange and the distal surface of the valve head.

8. The improvement according to claim 5 in which the rotary motion of the drive shaft is transmitted to the valve head by a pin extending through the primary shaft and extension piece thereof and engaging with in slots formed in the distal surface of the valve head.

* * * * *